US011559709B2

(12) United States Patent
Vandemark et al.

(10) Patent No.: US 11,559,709 B2
(45) Date of Patent: Jan. 24, 2023

(54) RECEPTACLE FOR SUPPRESSING AND CONTAINING A FIRE

(71) Applicant: CellBlock FCS, LLC, Standish, ME (US)

(72) Inventors: Dylan Francis Vandemark, Hiram, ME (US); Matthew Lloyd Vandemark, Hiram, ME (US)

(73) Assignee: CELLBLOCK FCS, LLC, Standish, ME (US)

( * ) Notice: Subject to any disclaimer, the term of this patent is extended or adjusted under 35 U.S.C. 154(b) by 88 days.

(21) Appl. No.: 16/583,555

(22) Filed: Sep. 26, 2019

(65) Prior Publication Data

US 2020/0101334 A1 Apr. 2, 2020

Related U.S. Application Data

(60) Provisional application No. 62/738,037, filed on Sep. 28, 2018.

(51) Int. Cl.

| | |
|---|---|
| ***A62C 3/00*** | (2006.01) |
| ***A62C 99/00*** | (2010.01) |
| ***B65D 81/38*** | (2006.01) |
| ***A62C 3/06*** | (2006.01) |

(52) U.S. Cl.

CPC ..... *A62C 3/002* (2013.01); *A62C 99/0045* (2013.01); *B65D 81/3802* (2013.01); *A62C 3/06* (2013.01)

(58) Field of Classification Search

CPC ..... A62C 3/002; A62C 99/0045; A62C 3/06; A62C 3/00; A62C 99/0009; A62C 2/06; B65D 2585/88; B65D 81/38; B65D 90/22; B65D 77/0486; B65D 77/0493; B65D 81/3886; F17C 13/004; B65F 2001/1494; B65F 2210/104; B65F 2250/107; B65F 2210/179

USPC ..... 169/54, 26; 220/88.1, 560.01, 88.2, 576

See application file for complete search history.

(56) References Cited

U.S. PATENT DOCUMENTS 1,325,769 A * 12/1919 Welch ..... B65F 1/14 169/26
1,874,243 A * 8/1932 Clark ..... A62C 3/06 169/60
2,212,618 A * 8/1940 Rifkin ..... B65F 1/14 206/521
2,669,030 A * 2/1954 English ..... B65F 1/14 34/69
2,933,917 A * 4/1960 Sampson ..... B65D 90/06 52/249

(Continued)

*Primary Examiner* — Chee-Chong Lee
*Assistant Examiner* — Kevin Edward Schwartz
(74) *Attorney, Agent, or Firm* — Shlesinger, Arkwright & Garvey, LLP

(57) ABSTRACT

The present invention is a shipping container adapted to isolate and extinguish a fire within the container, the container comprising a container body having a bottom, an interior wall defining an internal region, an opening into the internal region, a cover positionable over the opening, an insert or liner provided within the container and at a fixed distance from its interior wall, the insert having apertures extending therethrough, the region between the container's interior wall and bottom and the insert containing a free-flowing expanded glass granulate having fire insulating, fire suppressing and smoke absorbing properties.

20 Claims, 3 Drawing Sheets

(56) References Cited

U.S. PATENT DOCUMENTS

| | | | | | |
|---|---|---|---|---|---|
| 3,135,419 | A * | 6/1964 | Bulmer | B65D 25/16 | 220/560.01 |
| 3,489,223 | A * | 1/1970 | Bundo, Sr. | A24F 19/145 | 169/26 |
| 3,669,299 | A * | 6/1972 | Jones | B65D 81/3886 | 220/592.2 |
| 4,411,318 | A * | 10/1983 | Zeischegg | A62C 3/00 | 169/26 |
| 5,225,622 | A * | 7/1993 | Gettle | E04B 1/82 | 102/303 |
| 5,394,786 | A * | 3/1995 | Gettle | E04B 1/82 | 102/303 |
| 5,421,479 | A * | 6/1995 | Noorafshani | F42B 39/14 | 220/571 |
| 6,116,348 | A * | 9/2000 | Drakin | A62C 5/006 | 169/12 |
| 8,544,670 | B2 | 10/2013 | Brilmyer | | |
| 9,126,744 | B2 | 9/2015 | Peltz et al. | | |
| 9,180,324 | B2 | 11/2015 | Burkett | | |
| 9,415,248 | B2 | 8/2016 | Donahue | | |
| 9,578,942 | B2 | 2/2017 | Brilmyer et al. | | |
| 9,597,535 | B2 * | 3/2017 | Knijnenburg | A62C 31/28 | |
| 9,631,773 | B2 | 4/2017 | Gehlhausen et al. | | |
| 9,643,036 | B2 | 5/2017 | Burkett | | |
| 9,725,365 | B1 * | 8/2017 | Zubrod | C04B 24/14 | |
| 10,490,785 | B1 * | 11/2019 | Simontacchi | B60L 50/64 | |
| 10,962,340 | B2 * | 3/2021 | Ohlson | F42D 5/045 | |
| 2007/0131684 | A1 * | 6/2007 | Cirillo | F42B 39/14 | 220/88.1 |
| 2015/0069068 | A1 | 3/2015 | Hariram | | |
| 2017/0146191 | A1 | 5/2017 | Gehlhausen et al. | | |
| 2017/0155103 | A1 * | 6/2017 | Pasewald | H01M 50/256 | |
| 2019/0280259 | A1 * | 9/2019 | Bruns | H01M 50/24 | |

* cited by examiner

RECEPTACLE FOR SUPPRESSING AND CONTAINING A FIRE

CROSS-REFERENCE TO RELATED APPLICATIONS

This application claims the benefit of priority from U.S. Provisional Application Ser. No. 62/738,037 filed on Sep. 28, 2018, which is incorporated herein by reference.

FIELD OF THE INVENTION

The present invention relates to containers and in particular, ground transport containers for shipping flammable goods including, but limited to, damaged, defective and spent lithium-ion batteries or devices that contain such batteries.

BACKGROUND OF THE INVENTION

Consumer electronic devices such as mobile phones, tablet computers, laptop computers, e-readers, MP3 players and electronic toys, are powered by lithium-ion batteries. If improperly handled, manufactured or overcharged, lithium-ion batteries are subject to overheating and thermal runaway i.e. the battery spontaneously increases in temperature and begins to vent hot and toxic pressurized gases. This causes the lithium-ion fluid within the battery to burst into flames, reaching temperatures in excess of 2,000 degrees Fahrenheit. While it is possible to extinguish the flames by applying large amounts of water, the lithium inside of the battery may react with the electrolytes and water to generate hydrogen which can accelerate the fire. Sand or other granular minerals can be applied to a lithium-ion battery fire; however, these materials are fire resistant only and do not provide fire extinguishing properties. These fire suppression methods are not practical if the lithium battery fire occurs within a sealed shipping container during transport on tractor trailer or freight train.

Currently, shipping containers for spent or defective lithium-ion batteries or devices containing such batteries are limited to 55 gallon UN rated steel drums. These drums are intended to protect the batteries from damage and provide the minimal amount of protection from outside heat. Should a battery within the drum become compromised, it could fill the drum with smoke and flames and cause a massive explosion. Should the outside of the drum be exposed to a fire, the drum would only have to heat up to 450 degrees Fahrenheit for a lithium battery inside of the drum to experience thermal runaway. A cache of batteries is therefore unsafe against fires which may occur either inside the drum or outside of it.

Prior art solutions for shipping containers used to ship lithium-ion batteries include small scale boxes that are lined with ceramic fiber. These devices have been found to be too impractical for containing large quantities of batteries that require shipment. Additionally, these devices are constructed from cardboard or other non-metallic materials which renders them too fragile for commercial shipping and the containers provides no protection to its contents against a fire emanating outside the container.

Further, a shipping container, by its very nature, needs to be relatively inexpensive to manufacture. Shipping containers are often damaged during shipping, and a large number or containers are often required. To provide shipping container that can effectively contain and suppress an internal fire and shield the contents against an external fire, only adds to the cost of the overall device.

A need has therefore existed in the art for a rugged, cost efficient transport container that is adapted to isolate and extinguish a fire that might erupt within the container including, but not limited to, a fire caused by a lithium-ion battery and protect the contents of the container from a fire that might occur exterior of the container.

BRIEF SUMMARY OF THE INVENTION

The present invention is a shipping container adapted to isolate and extinguish a fire occurring within the container, the container comprising a container body having a bottom, an interior wall defining an internal region, an opening into the internal region, a cover positionable over the opening, an insert or liner provided within the container at a fixed distance from its interior wall, the insert having apertures extending therethrough, the region extending between the container's interior wall and bottom and the insert containing a free-flowing expanded glass granulate having fire insulating, fire suppressing and smoke absorbing properties.

DETAILED DESCRIPTION OF THE INVENTION

The fire suppressing and extinguishing container according to the present invention is adapted to receive one or more items that could undergo a thermal event, for example, a lithium-ion battery that might spontaneously ignite due to thermal runaway or an electronic device containing a lithium-ion battery. The disclosed container is particularly advantageous for use as a shipping container for ground transport. The present invention meets UN certification for containing and shipping dangerous goods and operates under DOT hazardous material special permit 20549. However, those skilled in the art will appreciate the present invention may also be useful for non-shipping applications, such as a container for holding lithium-ion batteries at a recycling facility or at an electronic device repair facility.

Figure 1:
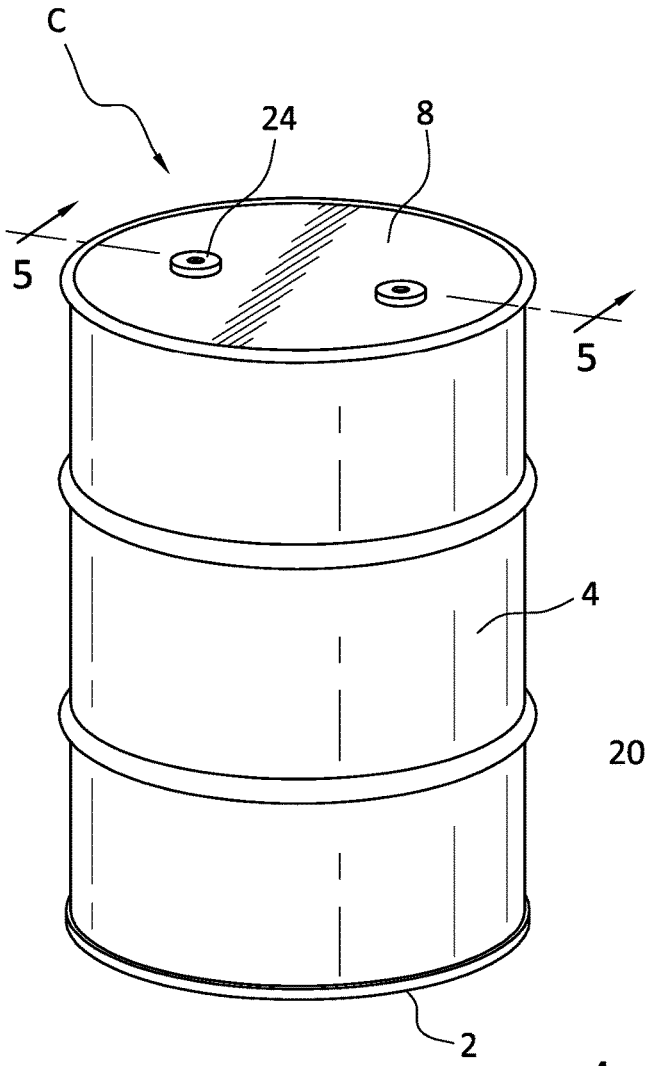
FIG. 1 is a perspective view showing the shipping container according to the present invention.
Figure 2:
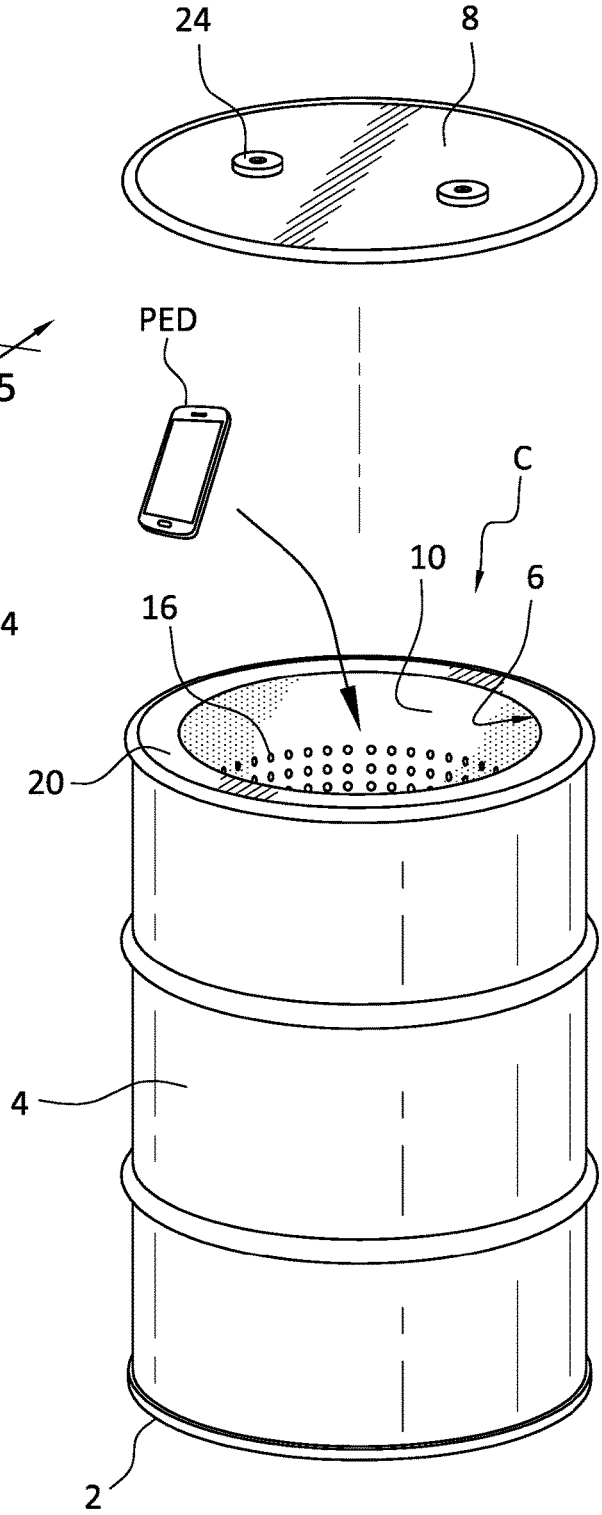
FIG. 2 is perspective view showing the shipping container according to the present invention when in an opened position with a consumer electronic device being shown for placement within the open container.
Figure 3:
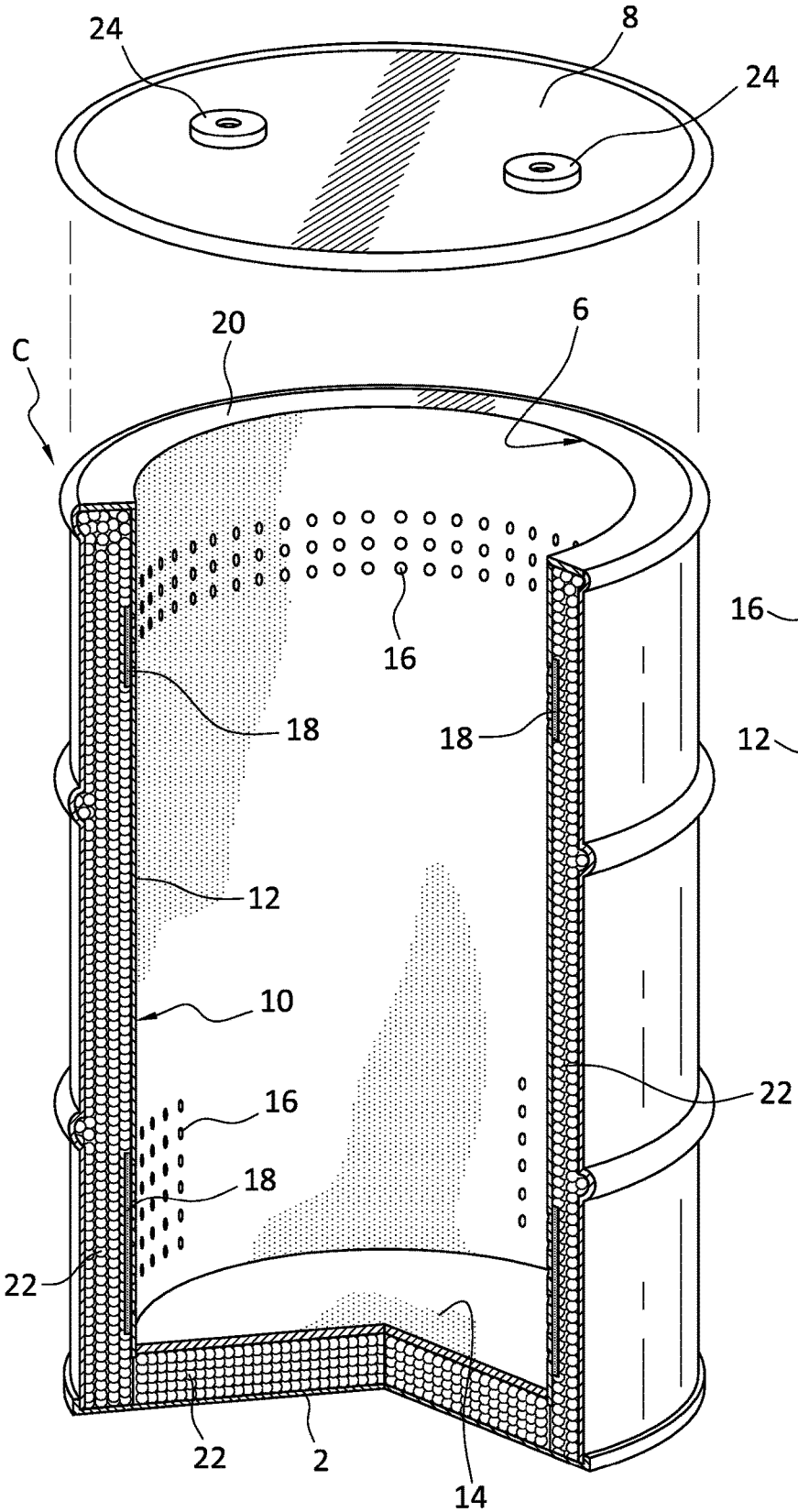
FIG. 3 is a perspective view of the device shown in FIG. 2 with portions broken away to expose the free-flowing expanded glass granulate.
Figure 4:
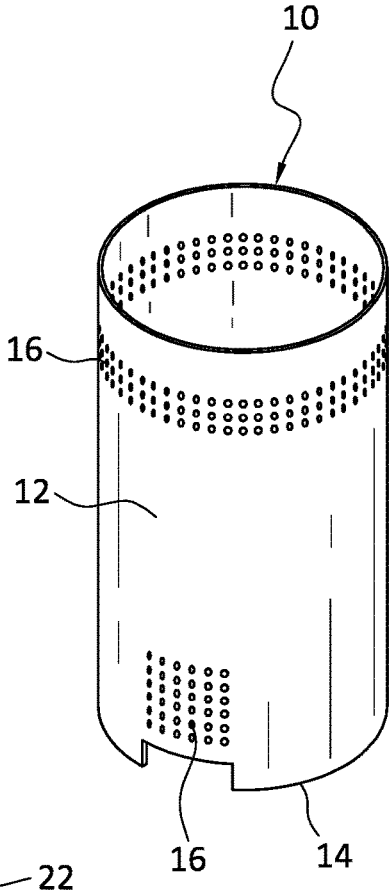
FIG. 4 is a perspective view of the liner member according to the present invention.

FIGS. 1, 2 and 3 show an embodiment of the shipping container according to the present invention. In this embodiment the container C is shown to be in the form of a steel 55 gallon UN rated drum. As is apparent, other metal construction materials and containers having varying size, shape and ratings are within the scope of the present invention. The present invention is scalable and may be sized as a relatively small 5 gallon bucket.

The container C is shown to have a bottom or floor 2 with a side wall 4 connected to the floor 2 and an interior region that extends below the opening 6 of the container. The floor 2 and the side wall 4 have an exterior container surface and an interior container surface. A cover or closure 8 is provided to seal or otherwise close the container C. In a preferred embodiment the cover is provided with one or more pressure relief valves that will release at around 1-3 psi. to prevent the drum from being over-pressurized during a fire event.

A rolled steel liner or insert 10 is provided within container C and secured to the interior surface of side wall 4 by a series of brackets (not shown) that are tack welded to the drum and pop riveted to the insert. Other securing methods are within the scope of the present invention. A collar 20 is provided at the opening 6 of the container which secures the insert 10 to the side wall 4 of the container. The metal insert 10 is shown to be generally cylindrical is shape and comprises a side wall 12 and bottom 14. Other insert shapes are within the scope of the present invention depending upon the configuration of the container.

The interior of the insert is preferably provided with a dielectric coating to render it non-conductive to electricity and therefore enhance the safety of the vessel. The liner is provided with strategically placed vent holes 16 disposed along its upper end and lower end. It is within the scope of the present invention to vary the location, size and quantity of the vent holes depending upon the general configuration of the container and its end use. In the drawings, the upper vent holes are shown to form a relatively narrow band extending the circumference of the insert. The lower vent holes are shown to be provided in separate regions on opposite sides of the insert.

A carbon cloth filter 18 may be provided against the vent holes to prevent material from passing through the vents and to permit filtering of the atmosphere within the container during a fire event.

In a preferred embodiment and when the container is a standard size 55 gallon drum, the distance between the insert and the interior surface of the container side wall and bottom will be about two inches. This width of this cavity or gap can be varied to provide more or less fire suppression characteristics depending upon the end use of the container or the nature of the goods being shipped i.e. if they are more or less likely to be combustible.

The entire gap or region extending between the insert and the floor 2 and side wall 4 of the container is filled with free flowing expanded glass granules 22. The granules are relatively small, lightweight spheres of expanded (i.e. foamed) silicon dioxide glass having interior pores that provide a closed cell structure and about 70-80% air by volume. The granules readily absorb heat and smoke and function as an insulator during a fire event and ultimately extinguish a fire within the container by displacing oxygen. The size of the aggregate correlates to its interior pore size and hence its relatively low density that enhances its utility as a reactive extinguisher. A commercially available expanded glass granulate suitable for use in the present invention is sold by Dennert Poraver GmbH under the EXTOVER trademark which is incorporated herein by reference.

Figure 5:
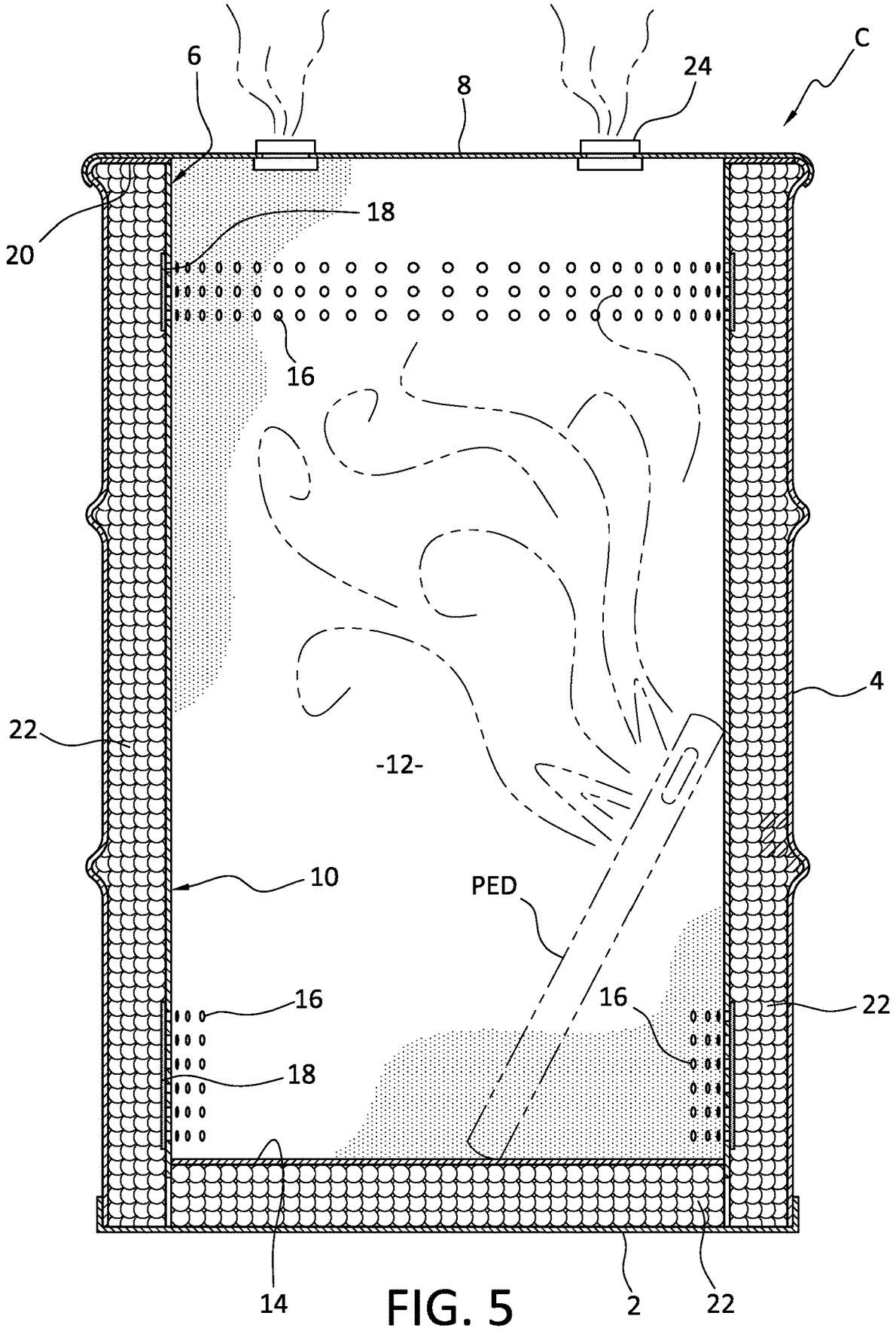
FIG. 5 is a cross-sectional view of the container shown in FIG. 1, taken along lines 5-5, with a consumer electronic device PED inside the container that has caught fire.

The size of the expanded glass granulate in the present invention is preferably non-uniform and comprises a blend of varying sized granules. The smallest size granules have relatively greater density and a smaller pore size while the largest sized granules have the lower density and a larger pore size. In a preferred embodiment, the size of the loose fill granulate is between about 1 mm diameter to about 4 mm in diameter. A suitable composition for the granulate is a blend of 1 mm, 2 mm, 3 mm and 4 mm diameter size spheres combined in a 1:1:1:1 ratio. The preferred blend has a total air content of about 70-80% by volume and an average density of about 10 1bs/ft & 3 to promote sufficient absorption of heat, provide enhanced insulative properties from the heat of the fire and also provide low heat transference. The intense heat generated by a lithium battery fire will cause at least some of the granules to melt however no toxic byproduct is produced. As best shown in FIG. 5, during a fire event, the gases generated by the battery will exit the vent holes 16 and be absorbed by the glass granules 22 with any remaining gases being vented by valves 24. The heat generated during a fire event is rapidly absorbed by the glass granules lining the container. Eventually, the oxygen is cut off within the container as it is absorbed by the granules and the fire will cease.

While this invention has been described as having a preferred design, it is understood that it is capable of further modifications, uses and adaptations, both in whole and in part, while following the general principle of the invention including such departures from the present disclosure as is known or customary practice in the art to which this invention pertains, and as may be applied to the central features of this invention.

We claim:

1. A shipping container adapted to isolate and extinguish a fire inside of the container, the container comprising:

a) a container body having a bottom;

b) an interior wall defining an internal region;

c) an opening into the internal region;

d) a cover positionable over the opening;

e) an insert disposed inside of the container and fixed to the container body, the insert has a side wall and a bottom defining an internal region, the insert is adjacent to and spaced from the container's interior wall and container body's bottom to define a fixed gap region between the insert and the container body, the side wall of the insert has apertures extending therethrough that extend through it from the insert's interior region and that communicate with the gap region; and f) a free-flowing expanded glass granulate having fire insulating, suppressing and smoke absorbing properties, the granulate is disposed between the insert and the container body's interior wall and bottom in the gap region, the granulate is restricted from passing through the apertures and into the insert's internal region whereby gas and heat generated during a fire within the internal region of the insert are conveyed through the apertures and into the gap region for suppression and absorption by the free-flowing expanded glass granulate.

2. The container as in claim 1 and wherein the free-flowing expanded glass granulate comprises foamed silicon dioxide glass spheres.

3. The container as in claim 2 and wherein the foamed silicon dioxide glass spheres have a diameter between 1 mm to 4 mm.

4. The container as in claim 3 and wherein the foamed silicon dioxide glass spheres are provided as a blend of spheres having a diameter of 1 mm, 2 mm, 3 mm and 4 mm and in a ratio of 1:1:1:1.

5. The container as in claim 1 and wherein the cover is provided with at least one pressure relief valve.

6. The container as in claim 1 and wherein the side wall and bottom of the insert are constructed from rolled metal material.

7. The container as in claim 1 and wherein the insert includes a collar extending from the insert to the container's interior wall.

8. The container as in claim 6 and wherein the insert has a di-electric coating.

9. The container as in claim 1 and wherein the apertures are separately located in only an upper region and a lower region of the insert.

10. The container as in claim 9 and further comprising a filter that is associated with the apertures.

11. The container as in claim 9 and wherein the insert is cylindrical and the apertures in the upper region of the insert are aligned as a band that extends the circumference of the insert.

12. The container as in claim 1 and wherein the apertures are provided in at least two regions near the bottom of the container and on opposite sides of the container.

13. A shipping container adapted to isolate and extinguish a fire inside of the container, comprising:

a) a container body having an exterior side wall and an exterior bottom wall;

b) an interior side wall spaced from the exterior side wall to define a first gap region therebetween;

c) an interior bottom wall spaced from the exterior bottom wall to define a second gap region therebetween, the interior bottom wall being attached to the interior side wall, the interior side wall and the interior bottom wall defining an internal region;

d) an opening into the internal region and a cover positionable over the opening;

e) a free-flowing expanded glass granulate disposed within the first gap region and the second gap region for suppressing a fire in the internal region;

f) the interior side wall including apertures communicating with the first gap region such that heat and smoke from the fire are conveyed through the apertures and suppressed by the free-flowing expanded glass granulate.

14. The container as in claim 13 and wherein the free-flowing expanded glass granulate comprises foamed silicon dioxide glass spheres.

15. The container as in claim 14 and wherein the foamed silicon dioxide glass spheres have a diameter between 1 mm to 4 mm.

16. The container as in claim 15 and wherein the foamed silicon dioxide glass spheres are provided as a blend of spheres having a diameter of 1 mm, 2 mm, 3 mm and 4 mm and in a ratio of 1:1:1:1.

17. The container as in claim 13 and wherein the cover is provided with at least one pressure relief valve.

18. The container as in claim 13 and wherein the apertures are only located in an upper region and a lower region of the interior side wall.

19. The container as in claim 13 and further comprising a filter that is associated with the apertures.

20. The container as in claim 13 and wherein the exterior side and bottom walls and the interior side and bottom walls are constructed from a metal material.

* * * * *